US010255890B2

(12) United States Patent
Kim et al.

(10) Patent No.: US 10,255,890 B2
(45) Date of Patent: Apr. 9, 2019

(54) DISPLAY CONTROLLER FOR REDUCING DISPLAY NOISE AND SYSTEM INCLUDING THE SAME

(71) Applicants: Bo Young Kim, Hwaseong-si (KR); Min Chul Kim, Hwaseong-si (KR); Hong Sik Park, Hwaseong-si (KR)

(72) Inventors: Bo Young Kim, Hwaseong-si (KR); Min Chul Kim, Hwaseong-si (KR); Hong Sik Park, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 71 days.

(21) Appl. No.: 15/006,157

(22) Filed: Jan. 26, 2016

(65) Prior Publication Data

US 2016/0225340 A1 Aug. 4, 2016

(30) Foreign Application Priority Data

Jan. 30, 2015 (KR) ..... 10-2015-0015449

(51) Int. Cl.

| | |
|---|---|
| ***G09G 5/395*** | (2006.01) |
| ***G09G 5/36*** | (2006.01) |
| ***G09G 3/20*** | (2006.01) |
| ***G09G 5/00*** | (2006.01) |

(52) U.S. Cl.

CPC ..... *G09G 5/395* (2013.01); *G09G 3/2096* (2013.01); *G09G 5/008* (2013.01); *G09G 5/363* (2013.01); *G09G 2360/127* (2013.01); *G09G 2370/04* (2013.01); *G09G 2370/16* (2013.01)

(58) Field of Classification Search

None

See application file for complete search history.

(56) References Cited

U.S. PATENT DOCUMENTS

| | | | | |
|---|---|---|---|---|
| 6,563,483 | B1 | 5/2003 | Sakumoto | |
| 8,171,332 | B2 | 5/2012 | Shen | |
| 8,289,259 | B2 | 10/2012 | Hori | |
| 8,531,375 | B2 | 9/2013 | Komori | |
| 2006/0119706 | A1* | 6/2006 | An | G09G 5/393 348/166 |
| 2009/0222603 | A1 | 9/2009 | Den Besten | |
| 2009/0237345 | A1* | 9/2009 | Kamada | G09G 3/3611 345/94 |
| 2009/0243990 | A1* | 10/2009 | Komori | G06F 7/584 345/99 |
| 2009/0251396 | A1 | 10/2009 | Hsu | |

(Continued)

FOREIGN PATENT DOCUMENTS

| | | |
|---|---|---|
| JP | 2004110063 | 4/2004 |
| JP | 2012002961 | 1/2012 |

(Continued)

*Primary Examiner* — Peter Hoang

(74) *Attorney, Agent, or Firm* — Volentine, Whitt & Francos, PLLC

(57) ABSTRACT

A display controller for reducing display noise includes a memory configured to store frame data including M-lines of data, where M is an integer of at least 2; a data size controller configured to variably adjust a size of data transmitted to the display device; and a display driving circuit configured to read data corresponding to the data size from the memory and transmit the data to the display device.

20 Claims, 14 Drawing Sheets

(56) References Cited

U.S. PATENT DOCUMENTS

| | | | | |
|---|---|---|---|---|
| 2010/0026618 | A1* | 2/2010 | Hori | G09G 3/20 345/99 |
| 2012/0256885 | A1 | 10/2012 | Kwon et al. | |
| 2013/0207955 | A1* | 8/2013 | Kim | G06F 3/038 345/212 |
| 2014/0098893 | A1* | 4/2014 | Ju | H04N 19/127 375/240.26 |
| 2016/0078813 | A1* | 3/2016 | Mizukoshi | G09G 3/3283 345/76 |

FOREIGN PATENT DOCUMENTS

| | | | |
|---|---|---|---|
| KR | 20070119373 | A | 12/2007 |
| KR | 20090013481 | A | 2/2009 |
| KR | 20090059217 | A | 6/2009 |

* cited by examiner

FIG. 8

| Index | Value |
|---|---|
| 1 | 11112222 |
| 2 | 11122221 |
| 3 | 11222211 |
| 4 | 12222111 |

FIG. 9

| Random Pattern | |
|---|---|
| Index | Value |
| 1→4 | 11112222 |
| 1'→6 | 22221111 |
| 2→1 | 11122221 |
| 2'→7 | 22211112 |
| 3→2 | 11222211 |
| 3'→5 | 22111122 |
| 4→8 | 12222111 |
| 4'→3 | 21111222 |

DISPLAY CONTROLLER FOR REDUCING DISPLAY NOISE AND SYSTEM INCLUDING THE SAME

CROSS-REFERENCE TO RELATED APPLICATIONS

This application claims priority under 35 U.S.C. § 119(a) from Korean Patent Application No. 10-2015-0015449 filed on Jan. 30, 2015, the disclosure of which is hereby incorporated by reference in its entirety.

BACKGROUND

Embodiments of the disclosure relate to a device for reducing display noise and a system including the same, and more particularly, to a display controller for reducing display noise of a display device supporting a mobile industry processor interface (MIPI) display serial interface (DSI) command mode interface and a system including the same.

Instruments, such as a smart phone and a tablet personal computer (PC), equipped with a high-resolution display device have been increasingly used. In such instruments, the quality of a display device is a big issue. Accordingly, there has been a lot of research into reducing display noise.

Meanwhile, devices using MIPI DSI transmission mode for data transfer between a system on chip (SoC) and a display device in mobile equipment have been increasingly used. Since the MIPI DSI standard is based on line-by-line image data transmission, a period in which a data lane stops due to an idle period or a stop state between lines necessarily exists. In this case, power noise of a display panel causes noise in the output of the display panel in association with a data lane of a MIPI DSI receiver.

SUMMARY

According to some embodiments of the disclosure, there is provided a display controller for controlling a display device. The display controller includes a memory configured to store frame data including M-lines of data, where M is an integer of at least 2; a data size controller configured to variably adjust a size of data transmitted to the display device; and a display driving circuit configured to read an amount of data corresponding to the data size from the memory and transmit the read data to the display device.

The data size controller may include a register configured to store a maximum number of lines and a random line generator configured to randomly change an assigned number of lines within a range not exceeding the maximum number of lines. The display driving circuit may read a number of lines of data from the memory identified by the assigned number of lines output from the random line generator and may transmit the read lines of data to the display device.

The display driving circuit may not transmit the read lines of data during an idle period and may transmit the read lines of data during a data transmission period. The duration of the data transmission period may vary with the assigned number of lines.

The register may further store a mode set signal. The assigned number of lines may be changed when the mode set signal is set to a first value and may be fixed when the mode set signal is set to a second value.

Alternatively, the data size controller may include a pattern storage configured to store a plurality of predetermined random number sequences, a pattern generator configured to generate a random pattern using the plurality of random number sequences stored in the pattern storage, and a data size determiner configured to determine the data size according to the random pattern.

The pattern generator may randomly shuffle the plurality of random number sequences to generate the random pattern.

The data size determiner may change the data size according to the random pattern in response to the mode set signal.

According to other embodiments of the disclosure, there is provided an electronic system including a display device and a display controller configured to control the display device. The display controller includes a memory configured to store frame data including M-lines of data, where M is an integer of at least 2; a data size controller configured to variably adjust a size of data transmitted to the display device; and a display driving circuit configured to read an amount of data corresponding to the data size from the memory and transmit the read data to the display device.

The data size controller may include a register configured to store a maximum number of lines and a random line generator configured to randomly change an assigned number of lines within a range not exceeding the maximum number of lines. The display driving circuit may read a number of lines of data from the memory identified by the assigned number of lines output from the random line generator and may transmit the read lines of data to the display device.

The register may further store a mode set signal. The assigned number of lines may be changed when the mode set signal is set to a first value and may be fixed when the mode set signal is set to a second value.

Power noise occurring in the display device when the mode set signal is set to the first value may be less than power noise occurring in the display device when the mode set signal is set to the second value.

The display driving circuit may convert the frame data stored in the memory into a signal complying with a Mobile Industry Processor Interface (MIPI®) standard and may transmit the signal to the display device. The display controller may operate in MIPI DSI (display serial interface) command mode.

According to further embodiments of the disclosure, there is provided a method of operating a display controller for controlling a display device. The method includes storing frame data including M-lines of data in a memory, where M is an integer of at least 2; variably adjusting a number of lines indicating the number of lines of data to be transmitted to the display device; and reading a number of lines of data identified by the variable number of lines from the memory and transmitting the read lines of data to the display device.

The variably adjusting the number of lines may include determining a sequence of data sizes for all of the frame data before transmission of the frame data is started. The sequence of data sizes may be a number sequence in which each number identifies a number of lines.

Alternatively, the variably adjusting the number of lines may include determining the number of lines for each data transmission period. The transmitting the read lines of data to the display device may include transmitting the number of lines of data corresponding to the determined number of lines to the display device during the data transmission period. No lines of data may be transmitted during an idle period alternating with the data transmission period.

According to further embodiments of the disclosure, there is provided a display controller having a display driving circuit that transfers a predetermined number of lines of data from a memory to a display device in each of a plurality of first transmission periods corresponding to a first display frame of data and each of a plurality of second transmission periods corresponding to a second display frame of data. Each of the first and second transmission periods alternates with an idle period in which no line of data is transferred from the memory to the display device, and each of the lines of data corresponds to a display line of the display device for one of the first and second display frames of data. A data size controller sets the predetermined number to a first value for one of the first transmission periods and sets the predetermined number to a second value, greater than the first value, for another of the first transmission periods.

BRIEF DESCRIPTION OF THE DRAWINGS

The above and other features and advantages of the disclosure will become more apparent by describing in detail exemplary embodiments thereof with reference to the attached drawings in which:

FIG. 8 is a table of number sequences stored in a pattern storage illustrated in FIG. 7 according to some embodiments of the disclosure;

FIG. 9 is a table of random patterns generated by a pattern generator illustrated in FIG. 7 according to some embodiments of the disclosure;

DETAILED DESCRIPTION OF THE EMBODIMENTS

Figure 1:
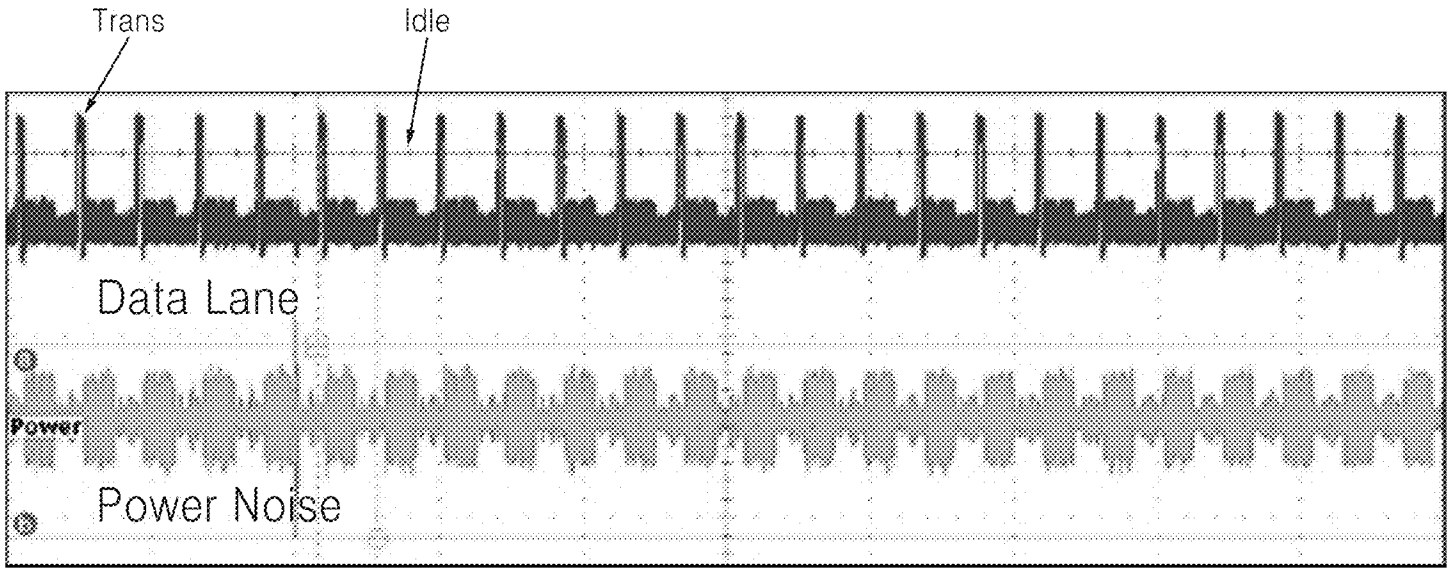
FIG. 1 is a timing chart of image data transmitted according to the mobile industry processor interface (MIPI) D-PHY standard.

The disclosure now will be described more fully hereinafter with reference to the accompanying drawings, in which embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Mobile industry processor interface (MIPI®) is a serial interface specification for connection between a processor and peripheral devices. It is a standard defined by the MIPI alliance. MIPI supports two display standards: video mode and command mode.

Figure 2:
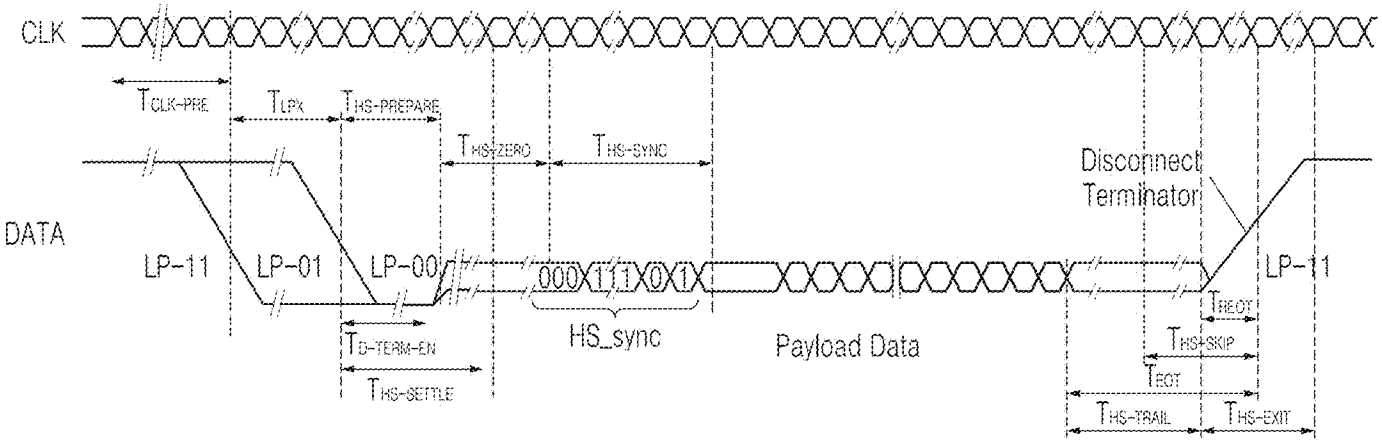
FIG. 2 is a diagram showing a signal of a data lane according to the data transmission timing illustrated in FIG. 1 and power noise occurring in a MIPI client like a display device.

FIG. 1 is a timing chart of image data transmitted according to the MIPI D-PHY standard. An MIPI host (e.g., a display controller) transmits image data line-by-line to an MIPI client (e.g., a display device) in the MIPI command mode. FIG. 2 is a diagram showing a signal of a data lane according to the data transmission timing illustrated in FIG. 1 and power noise occurring in an MIPI client, like a display device.

Referring to FIGS. 1 and 2, the signal of the data lane may have an image data transmission period "Trans" and an idle period "Idle" alternately repeating. Accordingly, power noise may occur in the MIPI client (e.g., a display device) at similar intervals to the signal of the data line. In other words, as shown in FIG. 2, a pattern in which power noise increases in each idle period "Idle" may occur. Therefore, the power noise in the display device needs to be reduced in order to increase display quality.

Figure 3:
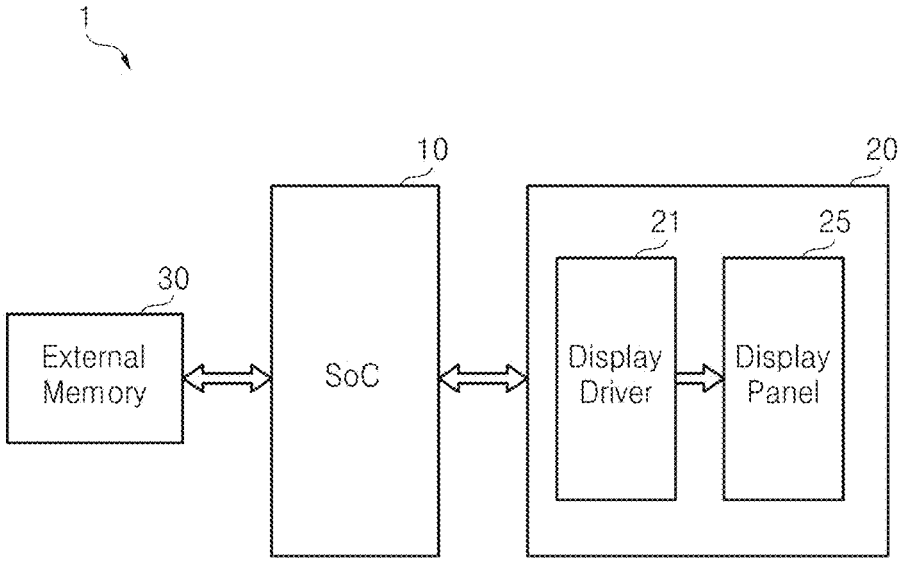
FIG. 3 is a block diagram of an electronic system according to some embodiments of the disclosure.
Figure 4:
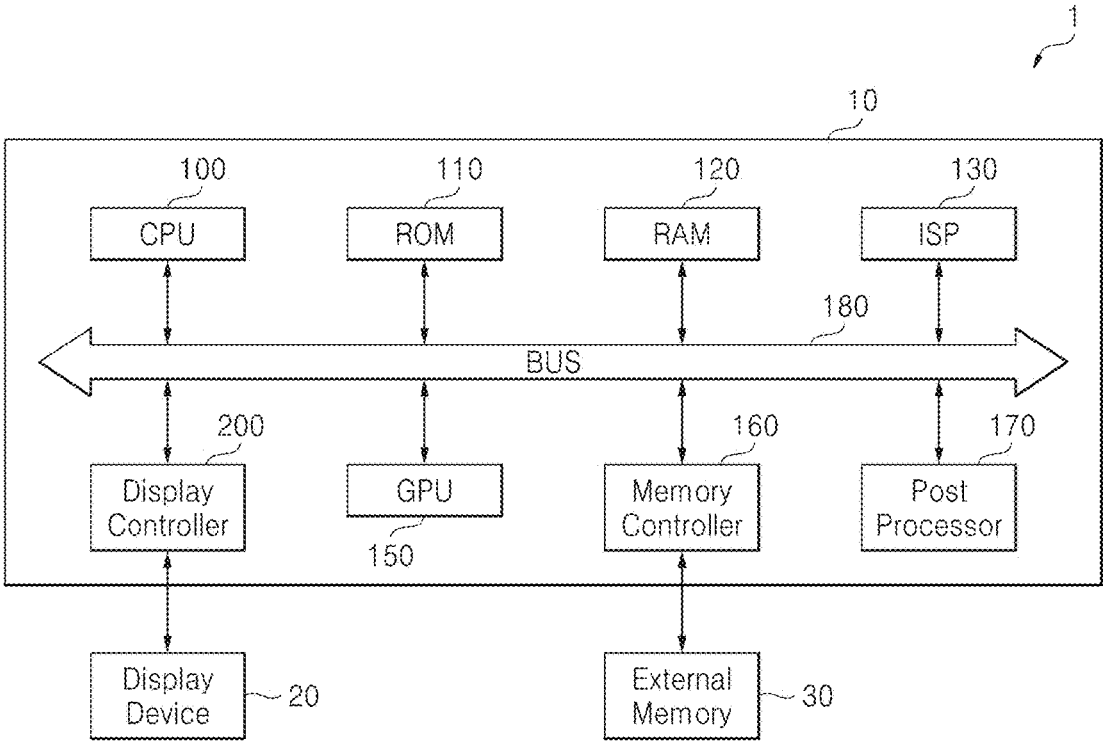
FIG. 4 is a block diagram of a system on chip (SoC) illustrated in FIG. 3 according to some embodiments of the disclosure.

FIG. 3 is a block diagram of an electronic system 1 including a semiconductor integrated circuit (IC) device according to some embodiments of the disclosure. The semiconductor IC device may be implemented as a system-on-chip (SoC) 10 or an application processor (AP). FIG. 4 is a block diagram of the SoC 10 illustrated in FIG. 3 according to some embodiments of the disclosure.

Referring to FIGS. 3, and 4, the electronic system 1 may be implemented as a portable device such as a laptop computer, a cellular phone, a smart phone, a tablet personal computer (PC), a personal digital assistant (PDA), an enterprise digital assistant (EDA), a digital still camera, a digital video camera, a portable multimedia player (PMP), a mobile internet device (MID), a wearable computer, an internet of things (IoT) device, or an internet of everything (IoE) device. The electronic system 1 may display a still image signal (or a still image) or a moving image signal (or a moving image) on a display panel 25.

A display device 20 includes a display driver 21 and the display panel 25. The SoC 10 and the display driver 21 may be formed in a single module, a single SoC, or a single package, e.g., a multi-chip package. Alternatively, the display driver 21 and the display panel 25 may be formed in a single module.

The display driver 21 controls the operation of the display panel 25 according to signals output from the SoC 10. For instance, the display driver 21 may transmit image data from the SoC 10 to the display panel 25 as an output image signal through a selected interface.

The display panel 25 may display an image signal output from the display driver 21. The display panel 25 may be implemented as a liquid crystal display (LCD) panel, a light emitting diode (LED) display panel, an organic LED (OLED) display panel, or an active-matrix OLED (AMOLED) display panel.

An external memory 30 stores program instructions executed in the SoC 10. The external memory 30 may also store image data used to display still images or a moving image in the display device 20. The moving image is a succession of different still images presented quickly.

The external memory 30 may be a volatile or non-volatile memory. The volatile memory may be dynamic random access memory (DRAM), static RAM (SRAM), thyristor RAM (T-RAM), zero capacitor RAM (Z-RAM), or twin transistor RAM (TTRAM). The non-volatile memory may be electrically erasable programmable read-only memory (EEPROM), flash memory, magnetic RAM (MRAM), phase-change RAM (PRAM), or resistive RAM (RRAM).

The SoC 10 controls the external memory 30 and/or the display device 20. The SoC 10 may be called an IC, a processor, an AP, a multimedia processor, or an integrated multimedia processor. The SoC 10 may include a central processing unit (CPU) 100, a read-only memory (ROM) 110, a RAM 120, an image signal processor (ISP) 130, a display controller 200, a graphics processing unit (GPU) 150, a memory controller 160, a post processor 170, and a system bus 180. The SoC 10 may also include other elements.

The CPU 100, which may be referred to as a processor, may process or execute programs and/or data stored in the external memory 30. For instance, the CPU 100 may process or execute the programs and/or the data in response to an operating clock signal output from a clock signal module (not shown).

The CPU 100 may be implemented as a multi-core processor. The multi-core processor is a single computing component with two or more independent actual processors (referred to as cores). Each of the processors reads and executes program instructions.

The CPU 100 executes an operating system (OS). The OS may manage resources (e.g., memory, display, and so on) of the electronic system 1. The OS may allocate resources to applications executed in the electronic system 1.

Programs and/or data stored in the ROM 110, the RAM 120, and/or the external memory 30 may be loaded to a memory (not shown) in the CPU 100 when necessary. The ROM 110 may store permanent programs and/or data. The ROM 110 may be implemented as erasable programmable ROM (EPROM) or EEPROM.

The RAM 120 may temporarily store programs, data, or instructions. The programs and/or data stored in the memory 110 or 30 may be temporarily stored in the RAM 120 according to the control of the CPU 100 or a booting code stored in the ROM 110. The RAM 120 may be implemented as DRAM or SRAM.

The ISP 130 may perform various processes on an image signal. The ISP 130 may process image data received from an image sensor (not shown). For instance, the ISP 130 may perform shake correction on image data received from the image sensor and may adjust a white balance. In addition, the ISP 130 may perform color correction with respect to brightness, contrast and so on, color balance, quantization, color conversion into another color space, and so on. The ISP 130 may periodically store processed image data in the external memory 30 through the system bus 180.

The GPU 150 may read and execute program instructions related with graphics processing. For instance, the GPU 150 may perform graphic figure processing at high speed. The GPU 150 may convert data read by the memory controller 160 from the external memory 30 into a signal suitable to the display device 20. Apart from the GPU 150, a graphic engine (not shown) or a graphic accelerator may be used for graphic processing.

The post processor 170 performs post processing on an image or an image signal for an output device (e.g., the display device 20). The post processor 170 may magnify or reduce or rotate an image to be suitable for the display device 20. The post processor 170 may store post-processed image data in the external memory 30 through the system bus 180 or may directly output to the display controller 200 on the fly through the system bus 180.

The memory controller 160 interfaces with the external memory 30. The memory controller 160 controls the overall operation of the external memory 30 and controls data exchange between a host and the external memory 30. For instance, the memory controller 160 may write data to the external memory 30 or read data from the external memory 30 at the request of the host. Here, the host may be a master device such as the CPU 100, the ISP 130, the GPU 150, or the display controller 200. The memory controller 160 may read image data from the external memory 30 and transmit it to the display controller 200 upon the image data request of the display controller 200.

The display controller 200 controls the operation of the display device 20. The display controller 200 receives image data, which will be displayed on the display device 20, through the system bus 180, converts the image data into a signal (for example, complying with an interface standard) suitable to the display device 20, and transmits the signal to the display device 20. For instance, the display controller 200 may transmit image data to the display device 20 according to MIPI® D-PHY standards. The display controller 200 may request frame data from the memory controller 160 at predetermined intervals and may receive image data frame by frame.

The elements 100, 110, 120, 130, 150, 160, 170, and 200 may communicate with one another through the system bus 180. In other words, the system bus 180 connects the elements of the SoC 10 with one another and functions as a passage of transmitting and receiving data among the elements. In addition, the system bus 180 functions as a passage of control signals among the elements. The system bus 180 may include a data bus (not shown) for transmitting data, an address bus (not shown) for transmitting address signals, and a control bus (not shown) for transmitting control signals. The system bus 180 may include a small bus, i.e., an interconnector for data communication among particular elements.

Figure 5:
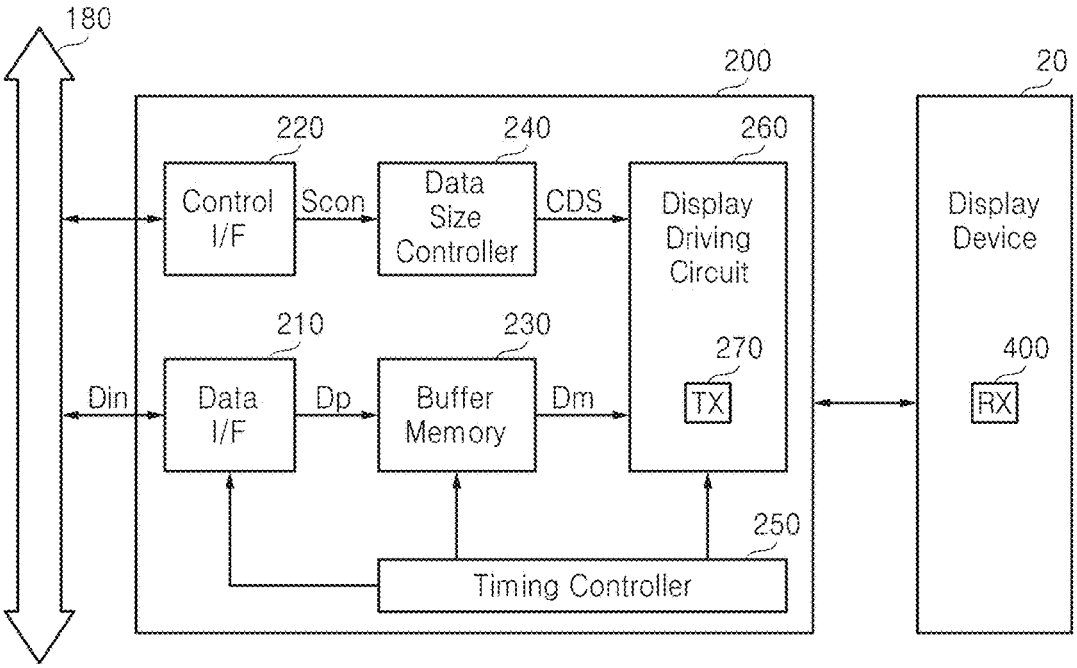
FIG. 5 is a block diagram of a display controller illustrated in FIG. 4 according to some embodiments of the disclosure.

FIG. 5 is a block diagram of the display controller 200 illustrated in FIG. 4 according to some embodiments of the disclosure. Referring to FIGS. 4 and 5, the display controller 200 may include a data interface (I/F) 210, a control I/F 220, a buffer memory 230, a data size controller 240, a timing controller 250, and a display driving circuit 260.

The data I/F 210 may receive input image data Din through the system bus 180 and may store it in the buffer memory 230. In detail, the data I/F 210 may request frame data from the memory controller 160 at predetermined intervals and may receive and store the input image data Din frame by frame in the buffer memory 230.

The source of the input image data Din may be diverse. For instance, the data I/F 210 may receive through a data bus the input image data Din output from the CPU 100, the external memory 30, the GPU 150, or another element (e.g., a scaler or a post processor) which is not shown.

The data I/F 210 may include at least one direct memory access (DMA) unit (not shown) which accesses memory and reads the input image data Din. The input image data Din may be R, G, and B data, but the disclosure is not restricted to the current embodiments.

The data I/F 210 may buffer and store the input image data Din in the buffer memory 230 or may process and store the input image data Din in the buffer memory 230. The data I/F 210 may blend or combine input image data Din received from at least two DMA units and store image data Dp resulting from the blending or combining in the buffer memory 230.

The control I/F 220 may receive a control signal from an element (e.g., a CPU) outside the display controller 200. For instance, the control I/F 220 may receive data size control information Scon including a maximum data size, a data size pattern, and/or a mode set signal from the CPU 100 and store the data size control information Scon in the data size controller 240.

The mode set signal is for setting the enablement or disablement of a data size control function according to some embodiments of the disclosure. When the mode set signal has a first value, the data size controller 240 may control so that the size (e.g., the number of lines) of data transmitted to the display device 20 is variably adjusted. When the mode set signal has a second value, the data size controller 240 may control so that the size (e.g., the number of lines) of data transmitted to the display device 20 is fixed. The mode set signal may be dynamically set by a user or may be dynamically set based on predetermined information.

The display driving circuit 260 converts image data stored in the buffer memory 230 into a signal suitable for transmission to the display device 20 (for example, a signal complying with a particular standard) and transmits the signal to the display device 20. The image data to be transmitted to the display device 20 may include a plurality of frames, each of which may include multiple lines of data. One line of data may include a plurality of pixel data.

For instance, when the resolution (i.e., the number of lines*the number of pixels) of the display panel 25 is m*n, each frame includes m-lines of data and one line of data includes "n" pixel data. Each pixel data may include R, G, and B data.

The timing controller 250 may output a control signal and a clock signal to control the overall operation timing of the display controller 200. The timing controller 250 may provide the display driving circuit 260 video control signals (i.e., MIPI DSI (display serial interface) commands) for controlling the display of image data formed of a plurality of lines and a plurality of frames. The timing controller 250 may also provide the display driving circuit 260 an input clock signal (not shown) used to receive image data Dm from the buffer memory 230 and an output clock signal (not shown) used to transmit image data to the display device 20.

The display driving circuit 260 may read the image data Dm from the buffer memory 230 according to a data size CDS assigned by the data size controller 240 and may transmit the image data Dm to the display device 20.

The data size controller 240 may assign the number of lines for the size CDS of data transmitted to the display device 20 and the display driving circuit 260 may transmit lines of data corresponding to the number of lines assigned by the data size controller 240 during a data transmission period. Accordingly, the display driving circuit 260 may transmit image data by integer multiples of lines to the display device 20.

The data size controller 240 may change an assigned number of lines within a range not exceeding a predetermined maximum number of lines to determine the number of lines of data to be transmitted during a single data transmission period. For instance, the data size controller 240 may randomly or pseudo-randomly generate the assigned number of lines for each data transmission period within the maximum number of lines. Image data is not transmitted during an idle period.

A data transmitter 270 in the display driving circuit 260 may transmit data to a data receiver 400 in the display device 20 according to MIPI standards and may be referred to as a master device or a host device. The data receiver 400 may receive data from the data transmitter 270 according to the MIPI standards and may be referred to as a slave device or a client device.

Figure 6:
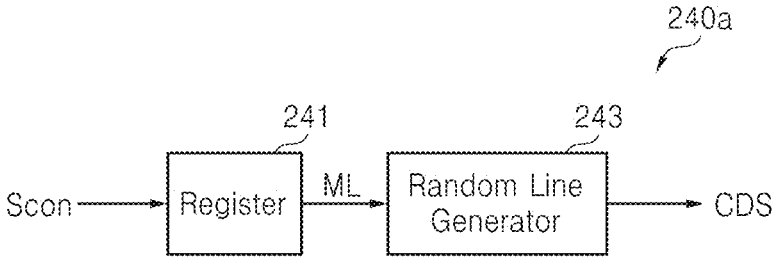
FIG. 6 is a block diagram of an example of a data size controller illustrated in FIG. 5.

FIG. 6 is a block diagram of an example 240*a* of the data size controller 240 illustrated in FIG. 5. Referring to FIGS. 5 and 6, the data size controller 240*a* may include a register 241 and a random line generator 243.

The register 241 may receive the control information Scon, which is necessary to generate a random number of lines, from the control I/F 220 and may store the control information Scon. The control information Scon may include a maximum number of lines ML and a mode set signal. The register 241 may also store resolution information of the display panel 25.

The mode set signal and the maximum number of lines ML may be set by a user or the CPU 100 in the register 241. The maximum number of lines ML may have been determined based on the resolution of the display panel 25, the size of the buffer memory 230, and so on and stored in the register 241 in advance.

When the mode set signal has been set to the first value, the random line generator 243 may randomly or pseudo-randomly generate an assigned number of lines within the maximum number of lines ML and output the assigned number of lines as the data size CDS. The random line generator 243 may be implemented as a random number generator which generates a random number according to a random number generating algorithm or a pseudo-random number generating algorithm.

For instance, when the maximum number of lines ML is 4, the random line generator 243 may sequentially generate random numbers of lines from 1 to 4 as the data size CDS (e.g., 1, 3, 4, 2, 1, 2, . . . ) to transmit a single frame image. Then, the display driving circuit 260 may sequentially transmit a number of lines of data corresponding to values 1, 3, 4, 2, 1, 2, . . . from the buffer memory 230 to the display device 20 according to the data size CDS (i.e., 1, 3, 4, 2, 1, 2, . . . ).

When the mode set signal is set to the second value, the random line generator 243 may output a fixed number of lines as the data size CDS.

In some embodiments, the control I/F 220 may receive and store a number sequence table, which has been predetermined or generated using a predetermined algorithm, in the register 241. FIG. 8 is a table of number sequences according to some embodiments of the disclosure. Referring to FIG. 8, the number sequence table may include at least two (e.g., four) number sequences and an index for indicating each number sequence.

Each of the number sequences may be a random number sequence made up of random numbers or pseudo-random numbers. Each number in a number sequence may be a value for assigning a data size, i.e., a number of lines. Accordingly, a random number sequence is a number sequence made of a plurality of numbers of lines in a predetermined sequence length (i.e., 8 in the embodiments illustrated in FIG. 8). In the embodiments illustrated in FIG. 8, a random number sequence corresponding to index 1 is "11112222" and a random number sequence corresponding to index 2 is "11122221".

The random line generator 243 may randomly generate a random number sequence index and may fetch a random number sequence corresponding to the random number sequence index from the register 241. The random line generator 243 may transmit the fetched random number sequence as the sequence of data sizes CDS to the display driving circuit 260. In this case, the data size CDS may not be a single value but may be a sequence made up of a plurality of values. The display driving circuit 260 transmits a number of lines of data from the buffer memory 230 to the display device 20 according to the sequence of data sizes (i.e., the random number sequence) received from the random line generator 243.

When the random line generator 243 determines a sequence of data sizes for data of a single frame, the sum of all values in the sequence of data sizes may be the same as the number of lines "m" of the resolution of the display panel 25.

Referring to FIG. 8, when a random number sequence index is "1", its corresponding random number sequence is "11112222". Accordingly, the display driving circuit 260 may change the number of lines of data to be output according to the numbers of lines "11112222" assigned by the random number sequence. In detail, when transmitting frame data, the display driving circuit 260 transmits one line of data in each of first through fourth data transmission periods and transmits two-lines of data in each of fifth through eighth data transmission periods. When the sequence of data sizes CDS is the random number sequence "11222211" corresponding to a random number sequence index of 3 in FIG. 8, the display driving circuit 260 may transmit one line of data in each of first and second data transmission periods, transmit two-lines of data in each of third through sixth data transmission periods, and transmit one line of data in each of seventh and eighth data transmission periods.

Figure 7:
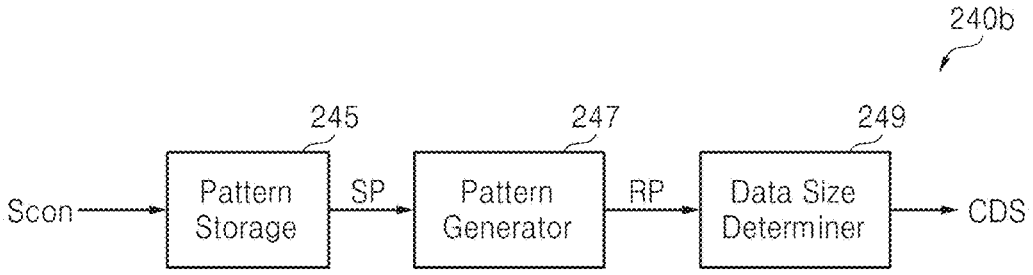
FIG. 7 is a block diagram of another example of the data size controller illustrated in FIG. 5.

FIG. 7 is a block diagram of another example 240*b* of the data size controller 240 illustrated in FIG. 5. Referring to FIGS. 5 and 7, the data size controller 240*b* may include a pattern storage 245, a pattern generator 247, and a data size determiner 249.

The pattern storage 245 may receive and store a random number sequence table. It is assumed that the random number sequence table stored in the pattern storage 245 is the same as the table illustrated in FIG. 8.

The pattern generator 247 may generate a random pattern RP using a random number sequence SP stored in the pattern storage 245. In some embodiments, the pattern generator 247 may randomly or pseudo-randomly shuffle random number sequence indexes stored in the pattern storage 245 and generate the random pattern RP corresponding to the shuffling result. Alternatively, the pattern generator 247 may generate a new random number sequence using (for example, inverting or shifting) a random number sequence stored in the pattern storage 245 and output the random pattern RP using the new random number sequence.

FIG. 9 is a table of random patterns generated by the pattern generator 247 illustrated in FIG. 7 according to some embodiments of the disclosure. Referring to FIG. 9, the pattern generator 247 may generate inverted random number sequences respectively corresponding to indexes 1', 2', 3', and 4' obtained by inverting original random number sequences illustrated in FIG. 8. The inverted random number sequence of the first random number sequence 1 (i.e., 11112222) is the first inverted random number sequence 1' (i.e., 22221111) and the inverted random number sequence of the second random number sequence 2 (i.e., 11122221) is the second inverted random number sequence 2' (i.e., 22211112).

The pattern generator 247 may randomly shuffle the original random number sequence indexes 1, 2, 3, and 4 and the inverted random number sequence indexes 1', 2', 3', and 4' to generate shuffled indexes 4, 6, 1, 7, 2, 5, 8, and 3 and may generate a random pattern corresponding thereto.

The data size determiner 249 may determine and output the data size CDS according to the random pattern RP output from the pattern generator 247. When the mode set signal has been set to the first value (e.g., "1"), the data size determiner 249 may determine the data size CDS according to the random pattern RP output from the pattern generator 247. When the mode set signal has been set to the second value (e.g., "0"), the data size determiner 249 may determine the data size CDS that has been fixed. The mode set signal may be stored in the pattern storage 245 or in a separate register (not shown).

Figure 10:
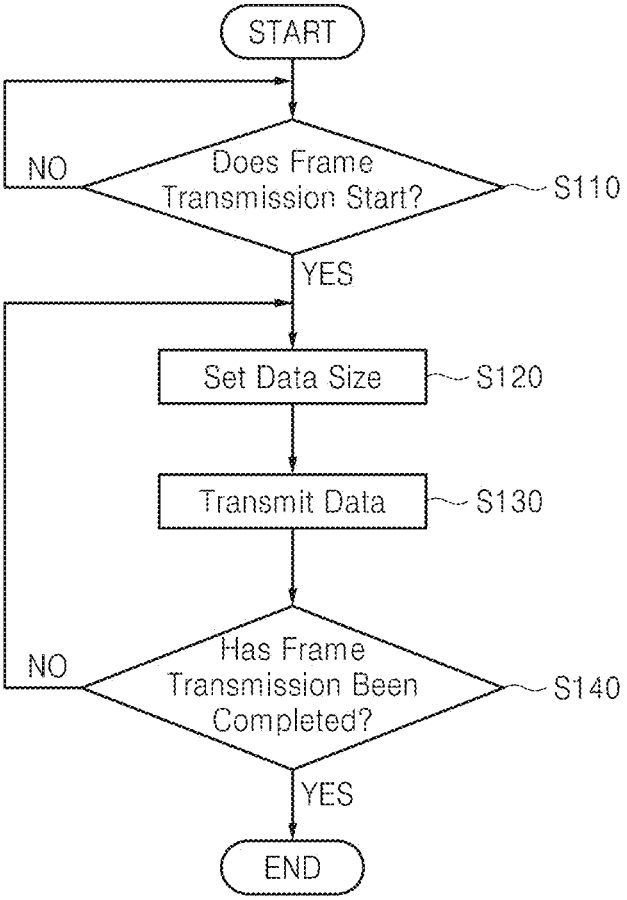
FIG. 10 is a flowchart of a method of operating a display controller according to some embodiments of the disclosure.

FIG. 10 is a flowchart of a method of operating a display controller according to some embodiments of the disclosure. The method illustrated in FIG. 10 may be performed by the display controller 200 illustrated in FIG. 5.

Referring to FIGS. 5 and 10, whether there is frame data to be transmitted is checked in operation S110. When there is frame data to be transmitted (in case of YES in operation S110), the data size controller 240 determines the size of data (i.e., number of lines) to be transmitted in operation S120. As described above, the data size controller 240 may randomly change the data size (e.g., a number of lines) or may fix the data size according to a mode set signal.

Thereafter, data corresponding to the determined data size is read from the buffer memory 230 and transmitted to the display device 20 in operation S130.

Operations S120 and S130 may be repeated until the transmission of the frame data is completed in operation S140. In other words, until the data of a frame is completely transmitted in operation S140, the data size (e.g., the number of lines) is repeatedly set in operation S120 and data corresponding to the data size (i.e., the number of lines) is transmitted in operation S130.

When it is assumed that the frame data includes 1024-lines of data, the data size may have any one of values of 1, 2, and 3, and an average data size is 2; operations S120 and S130 may be performed an average of 512 (i.e., 1024/2) times to transmit the frame data.

Alternatively, before the start of transmission of new frame data, a random pattern may be generated, a sequence of data sizes may be determined with respect to all of the frame data, and then data may be transmitted according to the sequence of data sizes. At this time, the sum of values in the sequence of data sizes may be the same as the number of lines "m" of the resolution of the display panel 25.

Figure 11:
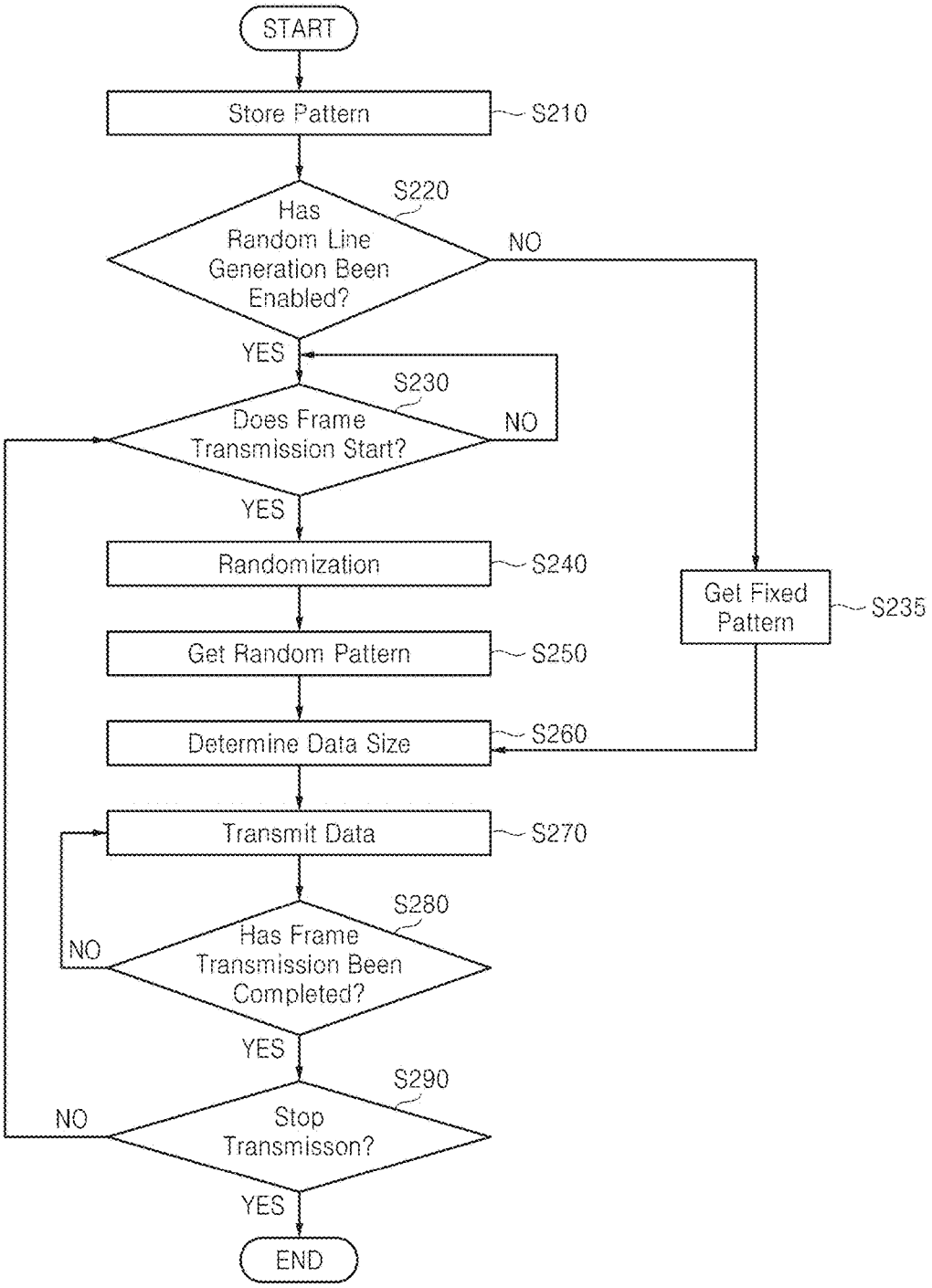
FIG. 11 is a flowchart of a method of operating a display controller according to other embodiments of the disclosure.

FIG. 11 is a flowchart of a method of operating a display controller according to other embodiments of the disclosure. The method illustrated in FIG. 11 may be performed by the display controller 200 illustrated in FIGS. 5 and 7.

Referring to FIGS. 5, 7, and 11, a pattern is stored in the pattern storage 245, in operation S210. Here, the pattern may be an original random number sequence. It is assumed that patterns stored in the pattern storage 245 are the same as the random number sequences illustrated in FIG. 8, in the embodiments illustrated in FIG. 11.

Whether random line generation has been enabled is checked in operation S220. The random line generation is an example of a data size changing function and may be selectively enabled or disabled according to a mode set signal. Accordingly, whether the random line generation has been enabled may be checked by checking the value of the mode set signal.

When the random line generation has been disabled, a fixed pattern having a fixed number of lines is generated in operation S235 and data is transmitted by a fixed number of lines in operation S270. When the random line generation has been enabled, the number of lines is randomly changed and data is transmitted by a variable number of lines in operations S230 through S270.

In detail, whether there is frame data to be transmitted is checked in operation S230. When it is found that there is frame data to be transmitted (in case of YES) in operation S230, the patterns stored in operation S210 are randomized in operation S240.

Figure 12:
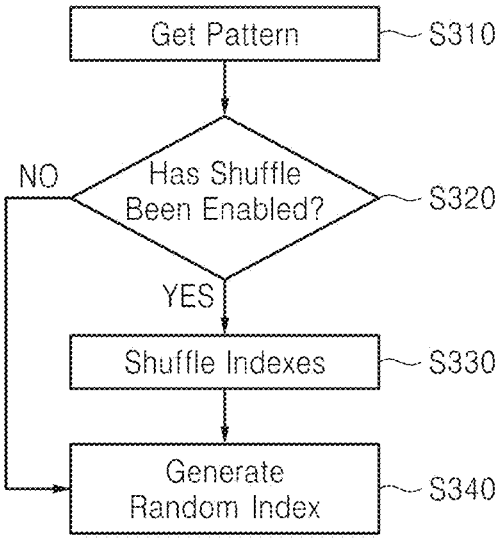
FIG. 12 is a flowchart of randomization in the method illustrated in FIG. 11 according to some embodiments of the disclosure.

FIG. 12 is a flowchart of the randomization in operation S240 illustrated in FIG. 11 according to some embodiments of the disclosure. The randomization illustrated in FIG. 12 may be performed by the pattern generator 247 illustrated in FIG. 7. Referring to FIGS. 7, 11, and 12, the patterns (e.g., original random number sequences) are read from the pattern storage 245 in operation S310. Whether a shuffle function has been enabled is checked in operation S320. A shuffle enable signal may be stored in the pattern storage 245 or in a separate register (not shown).

When it is checked that the shuffle function has been enabled (in case of YES) in operation S320, indexes of the random number sequences are randomly or pseudo-randomly shuffled in operation S330 to generate a random index sequence as shown in FIG. 9 in operation S340. When it is checked that the shuffle function has not been enabled (in case of NO) in operation S320, shuffling indexes of the original random number sequences in operation S330 is omitted and a random index sequence is generated based on the indexes of the original random number sequences (for example, in order or reverse order of the original random number sequences) in operation S340.

After the randomization in operation S240, a random pattern is obtained according to the random index sequence in operation S250. The number of lines of data to be transmitted is determined based on the random pattern in operation S260. Data corresponding to the determined data size (i.e., number of lines) is transmitted from the buffer memory 230 to a display device in operation S270. Operation S270 may be repeated until the transmission of the frame data is completed in operation S280.

Referring to FIG. 11, before the start of transmission of new frame data, patterns that have been stored are randomized to generate a random pattern in operations S240 and S250. A sequence of data sizes for the entire frame data is determined based on the random pattern in operation S260 and data having a variable number of lines are sequentially transmitted according to the sequence of data sizes in operation S270. Upon transmitting the entire frame of data, a determination is made in operation S290 whether to stop transmission. If the determination is yes, then the method of FIG. 11 is terminated. Otherwise, operation S230 is repeated for a next frame.

Alternatively, until the frame data is completely transmitted, an operation of determining the data size (e.g., the number of lines) and an operation of transmitting data corresponding to the data size may be sequentially and repeatedly performed.

Figure 13:
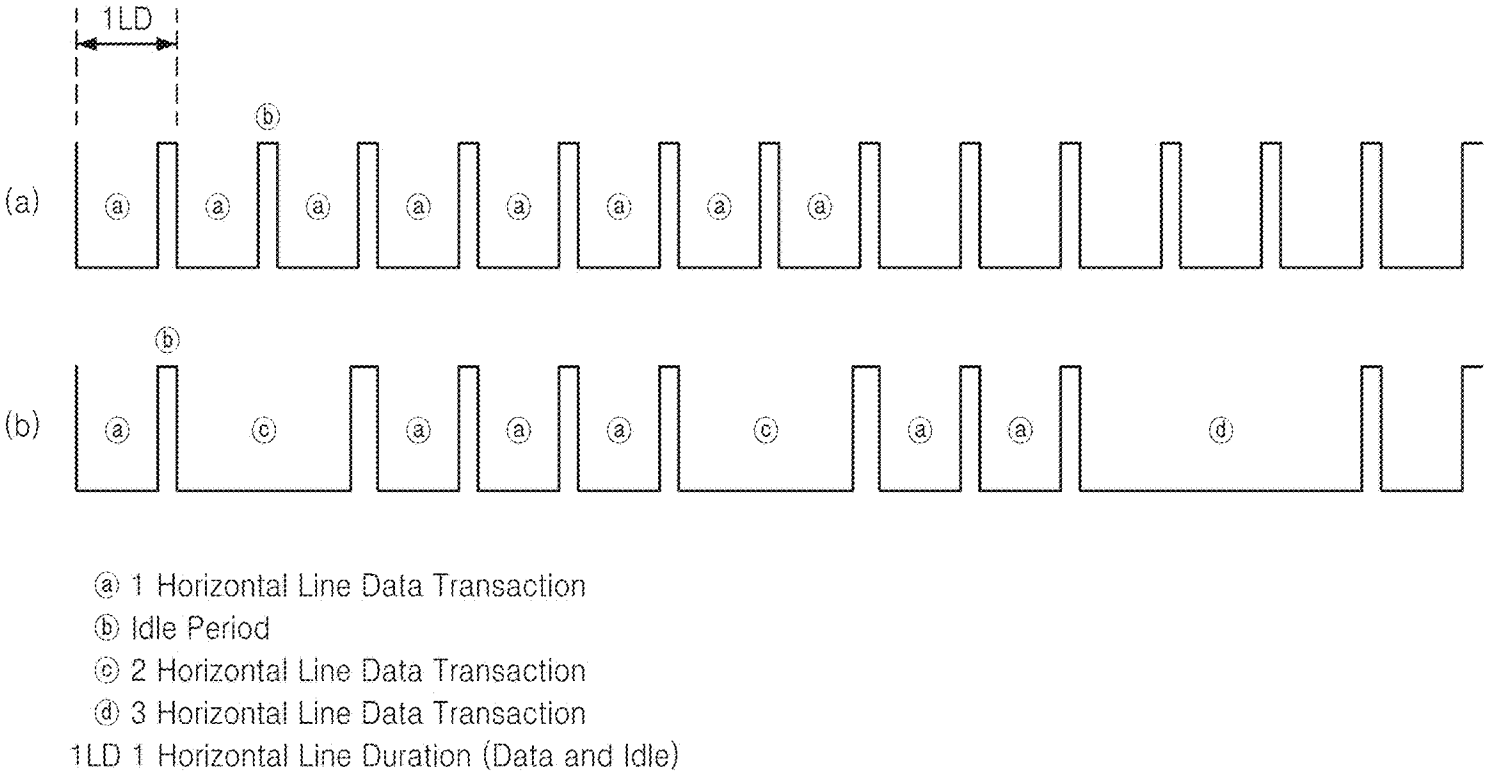
FIG. 13 is a diagram of data transmission timings of a display controller with respect to mode setting signals according to some embodiments of the disclosure.

FIG. 13 is a diagram of data transmission timings of a display controller with respect to mode setting signals according to some embodiments of the disclosure. In detail, part (a) of FIG. 13 shows data transmission timing in a case where a mode set signal has been set to a second value (for example, random line generation has been disabled) in the display controller and part (b) of FIG. 13 shows data transmission timing in a case where the mode set signal has been set to a first value (for example, random line generation has been enabled) in the display controller.

Referring to part (a) of FIG. 13, data is not transmitted during an idle period ⓑ and one line of data is transmitted during a data transmission period ⓐ between idle periods ⓑ. Here, the number of lines, i.e., data size transmitted during each data transmission period is fixed. In other words, the duration of the data transmission period is fixed. Accordingly, the data transmission period and the idle period alternate at regular intervals, so that power noise occurs in a receiving party (i.e., a display device) at regular intervals, as shown in FIG. 1.

However, referring to part (b) of FIG. 13, data is not transmitted during the idle period ⓑ and the data size, i.e., the number of lines transmitted during a data transmission period between idle periods ⓑ is changed. As shown in part (b) of FIG. 13, one line of data may be transmitted during the data transmission period ⓐ, two-lines of data may be transmitted during a data transmission period ⓒ, and three-lines of data may be transmitted during a data transmission period ⓓ. The size, i.e., number of lines of lines of data transmitted during a data transmission period is determined by the random line generator 240, as described above.

Since the duration of a data transmission period is variable, data transmission periods and idle periods do not occur at regular intervals. Therefore, power noise occurring in a receiving party (i.e., a display device) is reduced. For instance, in a case where the display controller transmits frame data, power noise occurring in a display device when a mode set signal is set to a first value in the display controller, that is, when the size (i.e., number of lines) of lines of data is variable, is less than power noise occurring in the display device when the mode set signal is set to a second value in the display controller, that is, when the size (i.e., number of lines) of lines of data is fixed.

As described above, according to some embodiments of the disclosure, the size, i.e., number of lines of data transmitted during a data transmission period is changed, so that the duration of a data transmission period and an idle period is changed. As a result, power noise is reduced in a display device. Since display noise is reduced, display quality and performance of equipment including the display device are increased.

Figure 14:
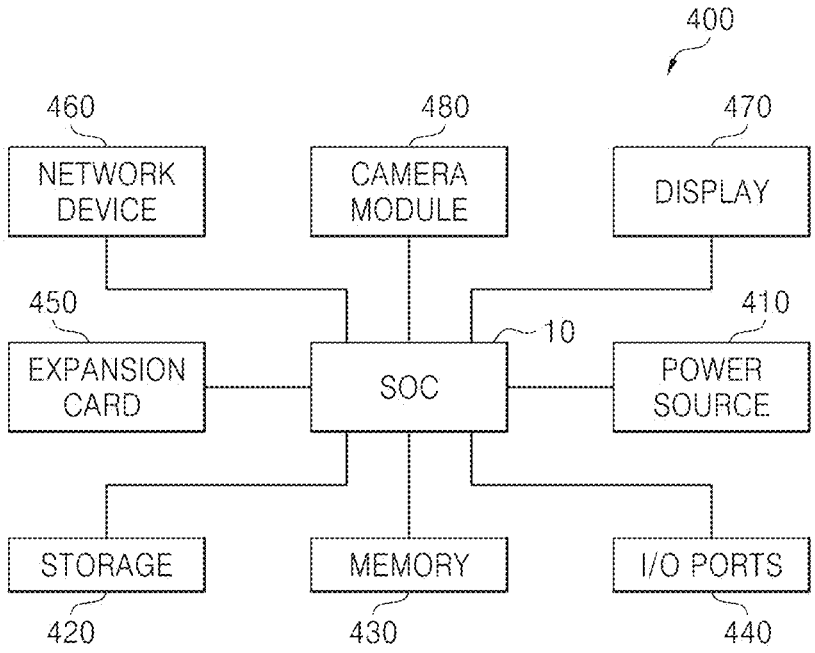
FIG. 14 is a block diagram of an electronic system including the SoC according to some embodiments of the disclosure.

FIG. 14 is a block diagram of an electronic system 400 including the SoC according to some embodiments of the disclosure. Referring to FIG. 14, the electronic system 400 may be implemented as a PC, a data server, a laptop computer or a portable device. The portable device may be a cellular phone, a smart phone, a tablet personal computer (PC), a personal digital assistant (PDA), an enterprise digital assistant (EDA), a digital still camera, a digital video camera, a portable multimedia player (PMP), portable navigation device (PDN), a handheld game console, or an e(electronic)-book device.

The electronic system 400 includes the SoC 10, a power source 410, a storage device 420, a memory 430, I/O ports 440, an expansion card 450, a network device 460, and a display 470. The electronic system 400 may further include a camera module 480.

The SoC 10 may control the operation of at least one of the elements 410 through 480. The SoC 10 corresponds to the SoC 10 illustrated in FIGS. 3 and 4.

The power source 410 may supply an operating voltage to at least one of the elements 10, and 420 through 480. The storage device 420 may be implemented by a hard disk drive (HDD) or a solid state drive (SSD).

The memory 430 may be implemented by a volatile or non-volatile memory. A memory controller that controls a data access operation, e.g., a read operation, a write operation (or a program operation), or an erase operation, on the memory 430 may be integrated into or embedded in the SoC 10. Alternatively, the memory interface may be provided between the SoC 10 and the memory 430.

The I/O ports 440 are ports that receive data transmitted to the electronic system 400 or transmit data from the electronic system 400 to an external device. For instance, the I/O ports 440 may include a port connecting with a pointing device such as a computer mouse, a port connecting with a printer, and a port connecting with a USB drive.

The expansion card 450 may be implemented as a secure digital (SD) card or a multimedia card (MMC). The expansion card 450 may be a subscriber identity module (SIM) card or a universal SIM (USIM) card.

The network device 460 enables the electronic system 400 to be connected with a wired or wireless network. The display 470 displays data output from the storage device 420, the memory 430, the I/O ports 440, the expansion card 450, or the network device 460.

The camera module 480 converts optical images into electrical images. Accordingly, the electrical images output from the camera module 480 may be stored in the storage module 420, the memory 430, or the expansion card 450. Also, the electrical images output from the camera module 480 may be displayed through the display 470.

The present general disclosure can also be embodied as computer-readable codes on a computer-readable medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices.

The computer-readable recording medium can also be distributed over network coupled computer systems so that the computer-readable code is stored and executed in a distributed fashion. Also, functional programs, codes, and code segments to accomplish the present general disclosure can be easily constructed by programmers.

While the disclosure has been particularly shown and described with reference to exemplary embodiments thereof, it will be understood by those of ordinary skill in the art that various changes in forms and details may be made therein without departing from the spirit and scope of the disclosure as defined by the following claims.

What is claimed is:

1. A display controller for controlling a display device, the display controller comprising:

a memory configured to store frame data comprising M-lines of data, where M is an integer of at least 2;

a data size controller configured to variably adjust a size of data transmitted to the display device during each of multiple transmission periods providing data of a same display frame; and a display driving circuit configured to read an amount of data corresponding to the size of data from the memory and transmit read data to the display device, wherein:

the data size controller is configured to randomly change an assigned number of lines, and the display driving circuit reads, for each of the multiple transmission periods providing the data of the same display frame, a number of lines of data from the memory identified by the assigned number of lines and transmits read lines of data to the display device.

2. The display controller of claim 1, wherein the data size controller comprises:

a register configured to store a value of a maximum number of lines; and a random line generator is configured to randomly change the assigned number of lines within a range not exceeding the value of the maximum number of lines.

3. The display controller of claim 2, wherein the display driving circuit does not transmit the read lines of data during an idle period and transmits the read lines of data during a data transmission period, and a duration of the data transmission period varies with the assigned number of lines.

4. The display controller of claim 2, wherein the register further stores a mode set signal, the assigned number of lines is changed when the mode set signal is set to a first value, and the assigned number of lines is fixed when the mode set signal is set to a second value.

5. The display controller of claim 2, wherein the random line generator generates the assigned number of lines according to a random number generating algorithm or a pseudo-random number generating algorithm.

6. The display controller of claim 1, wherein the data size controller comprises:

a pattern storage configured to store a plurality of predetermined random number sequences;

a pattern generator configured to generate a random pattern using the plurality of predetermined random number sequences stored in the pattern storage; and a data size determiner configured to determine the data size according to the random pattern.

7. The display controller of claim 6, wherein the pattern generator randomly shuffles the plurality of predetermined random number sequences to generate the random pattern.

8. The display controller of claim 6, wherein the data size determiner changes the data size according to the random pattern in response to a mode set signal.

9. The display controller of claim 1, wherein the display driving circuit converts the frame data stored in the memory into a signal complying with a predetermined standard and transmits the signal to the display device.

10. The display controller of claim 9, wherein the predetermined standard is Mobile Industry Processor Interface (MIPI®) and the display controller operates in MIPI DSI (display serial interface) command mode.

11. An electronic system comprising:

a display device including a display driver configured to control an operation of a display panel; and a System-on-Chip (SoC) including a display controller configured to control the display device, wherein the display controller comprises:

a memory configured to store frame data comprising M-lines of data, where M is an integer of at least 2;

a data size controller configured to variably adjust a size of data transmitted to the display device during each of multiple transmission periods providing data of a same display frame; and a display driving circuit configured to read an amount of data corresponding to the size of data from the memory and transmit read data to the display device, wherein:

the data size controller comprises a random line generator configured to randomly change an assigned number of lines for each of the multiple transmission periods providing the data of the same display frame, and the display driving circuit reads, for each of the multiple transmission periods providing the data of the same display frame, a number of lines of data from the memory identified by the assigned number of lines for the respective transmission period and transmits read lines of data to the display device.

12. The electronic system of claim 11, wherein:

the data size controller comprises a register configured to store a value of a maximum number of lines; and the random line generator is configured to randomly change the assigned number of lines within a range not exceeding the maximum number of lines.

13. The electronic system of claim 12, wherein the display driving circuit does not transmit the read lines of data during an idle period and transmits the read lines of data during a data transmission period, and a duration of the data transmission period varies with the assigned number of lines.

14. The electronic system of claim 12, wherein the register further stores a mode set signal, the assigned number of lines is changed when the mode set signal is set to a first value, and the assigned number of lines is fixed when the mode set signal is set to a second value.

15. The electronic system of claim 14, wherein power noise occurring in the display device when the mode set signal is set to the first value is less than power noise occurring in the display device when the mode set signal is set to the second value.

16. A display controller comprising:

a display driving circuit that transfers a predetermined number of lines of data from a memory to a display device in each of a plurality of first transmission periods providing data of a first display frame of data and each of a plurality of second transmission periods providing data of a second display frame of data, each of the first and second transmission periods alternating with an idle period in which no line of data is transferred from the memory to the display device, and each of the lines of data corresponding to a display line of the display device for one of the first and second display frames of data; and a data size controller that sets the predetermined number of lines of data to a first value for one of the first transmission periods and sets the predetermined number to a second value, greater than the first value, for another of the first transmission periods.

17. The display controller of claim 16, wherein for each of the first transmission periods, the data size controller sets the predetermined number to a value determined by a random number generating algorithm, a pseudo-random number generating algorithm, or a predetermined pattern.

18. The display controller of claim 16, wherein the idle period alternating with the other of the first transmission periods is longer than the idle period alternating with the one of the first transmission periods.

19. The display controller of claim 16, wherein a length of each of the idle periods is directly proportional to the predetermined number of lines of data that are transferred from the memory to the display device in a corresponding transmission period.

20. The display controller of claim 16, wherein the data size controller sets the predetermined number to same value for each of the second transmission periods.

* * * * *